US005853171A

United States Patent [19]

Halpenny

[11] Patent Number: 5,853,171

[45] Date of Patent: Dec. 29, 1998

[54] MEDIA LEVEL INDICATOR

[76] Inventor: Thomas J Halpenny, 2826 NW. 189th St., Ridgefield, Wash. 98642

[21] Appl. No.: 783,811

[22] Filed: Jan. 16, 1997

[51] Int. Cl.[6] ..... B65H 1/08

[52] U.S. Cl. ..... 271/126; 271/147; 271/258.03; 271/258.04; 271/259; 271/265.02

[58] Field of Search ..... 271/126, 127, 271/110, 153, 154, 155, 258.03, 258.04, 259, 265.02, 265.01, 147

[56] References Cited

U.S. PATENT DOCUMENTS 4,976,421 12/1990 Kanaya ..... 271/155
5,354,044 10/1994 Firl et al. ..... 271/4
5,362,038 11/1994 Giles et al. ..... 271/10
5,622,364 4/1997 Dutton et al. ..... 271/258.04
5,743,518 4/1998 Takashimizu et al. ..... 271/265.02

*Primary Examiner*—H. Grant Skaggs

[57] ABSTRACT

A media level indicator is provided to identify the amount of media in an input stack of a sheet processing device. The media level indicator includes an odometer mechanism configured to survey the printer's feed mechanism so that it may quantify movement of a selected sheet during a predetermined feed operation. The quantified movement thereafter is interpreted to indicate the amount of media in the input stack.

18 Claims, 3 Drawing Sheets

MEDIA LEVEL INDICATOR

TECHNICAL FIELD

The present invention relates generally to sheet processors, and more particularly, to a level indicator which determines the amount of media accessible to a sheet processing device. Although the invention has broad utility, it is described below in the context of an ink-jet printer, a device wherein particular utility has been shown.

BACKGROUND ART

In a conventional ink-jet printer, media is fed into the printer's print mechanism via an arrangement of rollers, the rollers being configured to selectively engage media in an input tray. The tray typically holds a stack of sheet media, accommodating transfer of media sheets in a seemingly abundant supply. However, although ink-jet printers may carry a substantial supply of media, the media eventually will be consumed, resulting in undesirable printer down time. Such down time may occur before, during or after a print job, disrupting printer operation until an operator notices the problem and replenishes the media supply.

One way of minimizing printer down time would be to identify a "low-media" condition so that the input tray could be replenished prior to completely depleting the media supply. This could be accomplished by a watchful operator, but more desirably would be accomplished automatically by the printer without the need for operator involvement. Even more desirably, the printer could be adapted to signal the operator that there is a "low-media" condition in time for the operator to address the problem by replenishing the media supply. What is needed is an automated media level indicator capable of determining the amount of media in the input stack of a sheet processing device such as a printer.

DISCLOSURE OF THE INVENTION

The aforementioned problems are addressed by provision of a media level indicator which determines the amount of media in an input stack of a sheet processing device. The invented media level indicator includes an odometer mechanism configured to survey the printer's feed mechanism so that it may quantify movement of a selected sheet during a predetermined feed operation. The quantified movement thereafter is interpreted to indicate the amount of media in the input stack.

In the preferred embodiment, the odometer mechanism surveys the printer's feed motor, operation of such motor being indicative of the distance traveled by the selected sheet during a feed operation. Upon initiating a feed operation, the motor moves the input stack from a predetermined first position, wherein the selected sheet is spaced from the printer's input port, to an operation-specific second position, wherein the selected sheet is positioned for passage into the input port. As the amount of media in the input stack decreases, the distance which is traveled by the input stack to bring the selected sheet to the input port will increase. Accordingly, by quantifying the distance between the first and second positions of the input stack, it is possible to determine the amount of media in the input stack.

The distance traveled by the input stack may be quantified by the amount of time to complete a feed operation, by the number of steps the feed motor takes during a feed operation, or by some other measurement of the distance traveled by the selected sheet during a feed operation. The feed operation typically begins with a feed command, and concludes with receipt of the selected sheet. In the preferred embodiment, the printer employs sensors which define the feed operation, typically by sensing arrival of the sheet at a predetermined point along the sheet's feed path.

The printer also may employ a comparator including an array operatively connected to the odometer mechanism to receive and store data values representing quantified movements of successive feed operations. Each data value then may be compared to an average of N previous data values, a predetermined variance between the current data value and the average data value being indicative of an inaccurate reading.

These and other objects and advantages of the present invention will be understood more readily upon consideration of the drawings and the detailed description of the preferred embodiment which is set forth below.

DETAILED DESCRIPTION OF THE PREFERRED EMBODIMENT AND BEST MODE FOR CARRYING OUT THE INVENTION

Figure 1:
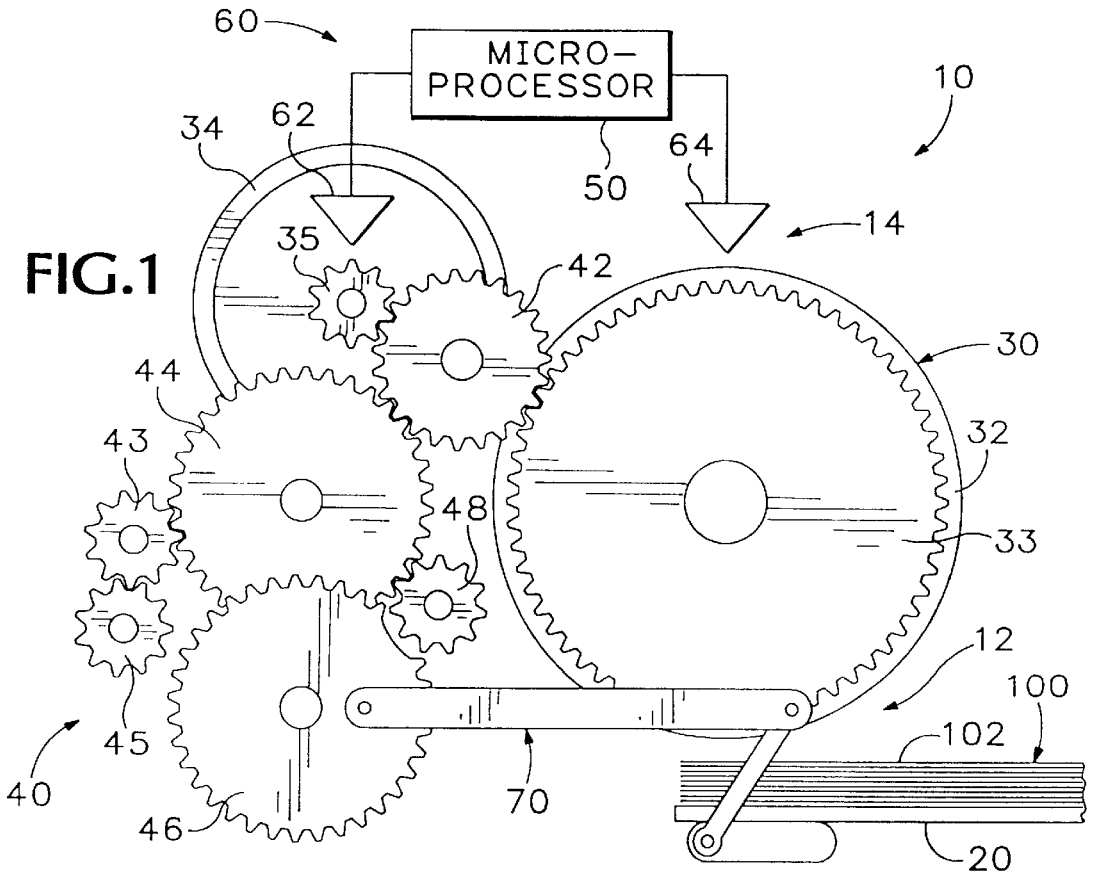
FIG. 1 is a somewhat schematic side view of a printer including a media level indicator constructed in accordance with a preferred embodiment of the invention.
Figure 2:
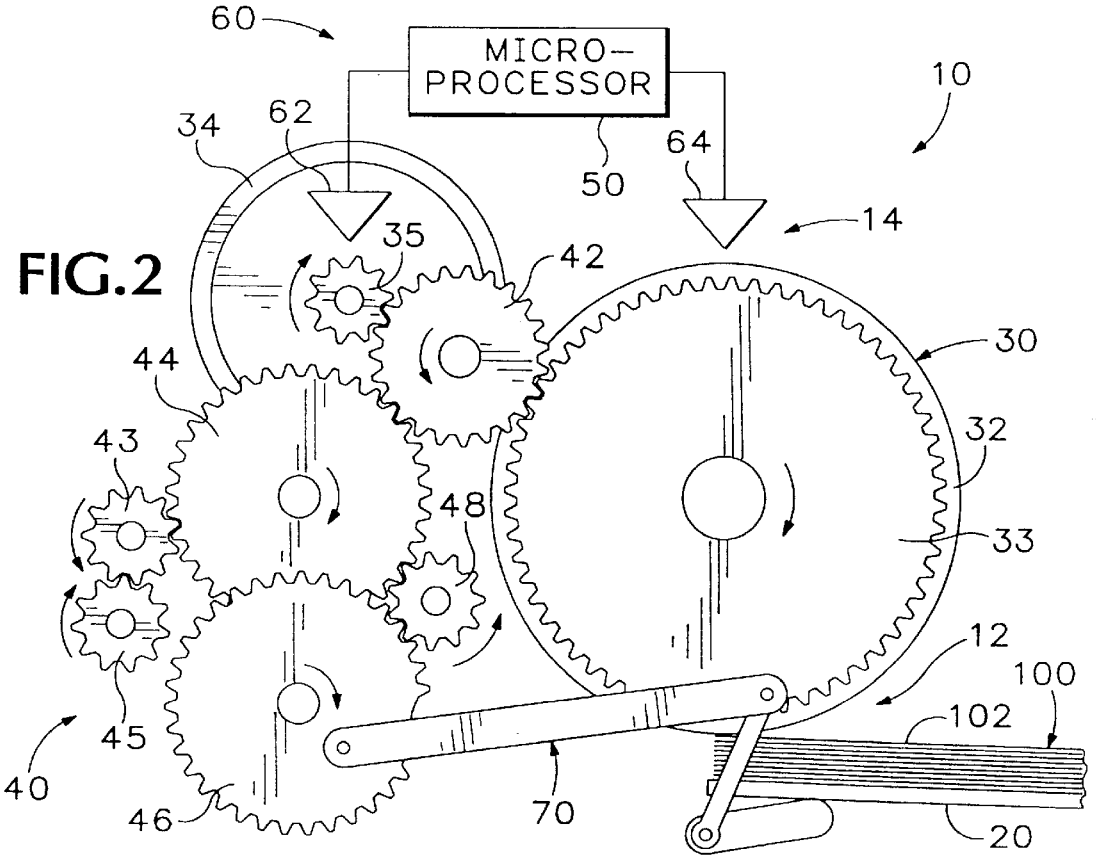
FIG. 2 is a view similar to that of FIG. 1, but with the printer's input stack moved to a first feed orientation determined by carriage of a first amount of media in the input stack.
Figure 3:
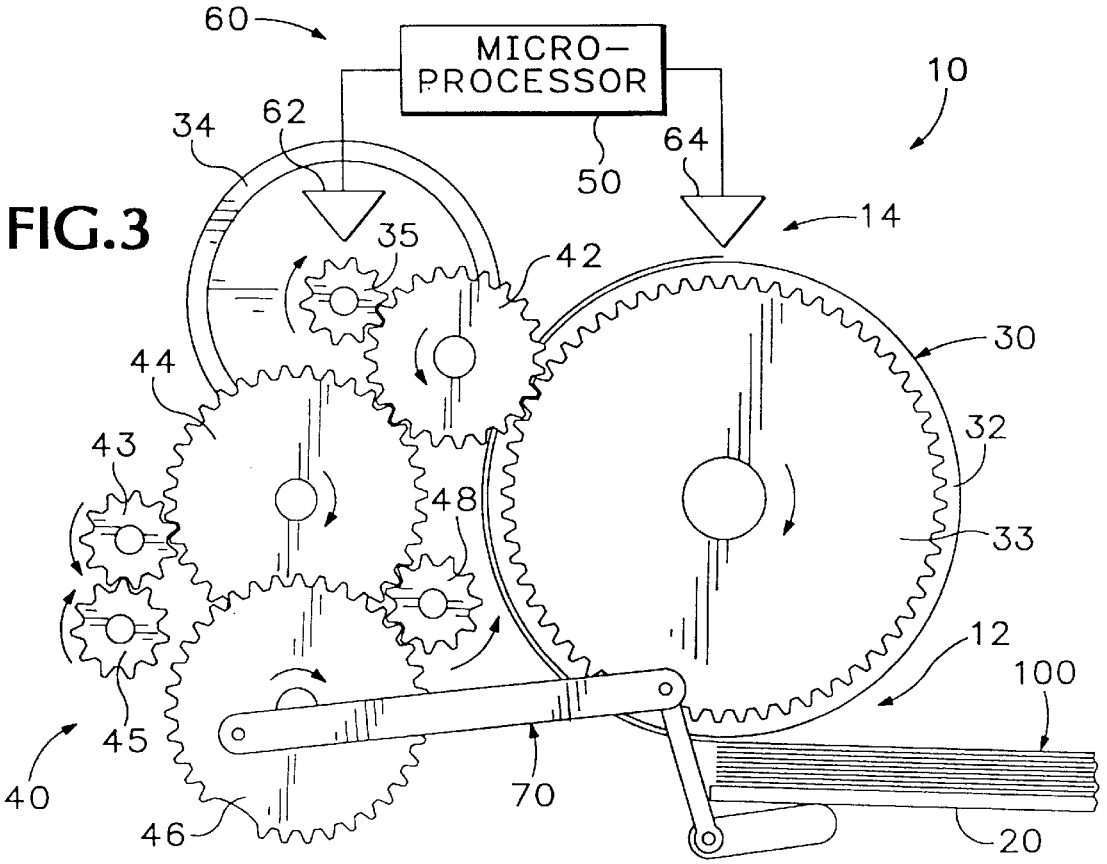
FIG. 3 is a view similar to that of FIG. 2, but showing a top sheet of the input stack fed into the printer.

Referring initially to FIGS. 1–3, a somewhat schematic representation of a sheet-processing device is provided, such device being indicated generally at 10. The sheet-processing device typically takes the form of an ink-jet printer which is configured to receive media such that an image may be deposited thereon. In the depicted device, the media is received through an input port 12, a print operation is performed, and the media is expelled through an output port 14.

As indicated, media is fed from an input stack 100 defined by a plurality of individual sheets (e.g., 102). In the depicted embodiment, the input stack is contained within an input tray 20, the tray being configured to carry sheets for delivery through the printer's input port. Sheets are drawn into the printer using a feed mechanism 30, which typically employs one or more frictional feed rollers 32. The feed rollers are driven by a stepper motor 34, generally via an arrangement of gears 40 and under control of a microprocessor or the like.

Figure 4:
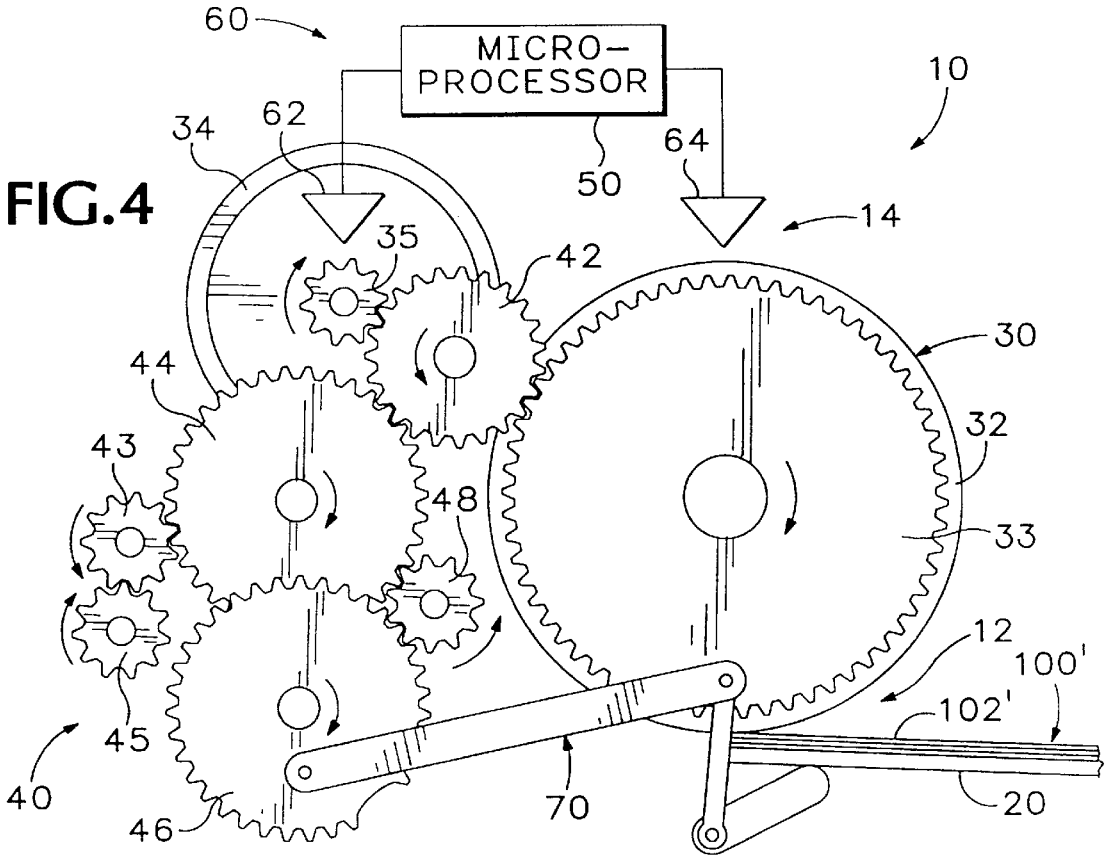
FIG. 4 is a view similar to that of FIG. 2, but with the printer's input stack moved to a second feed orientation determined by carriage of a second, lesser amount of media in the input stack.

In accordance with my teachings, the input tray is configured for movement between a predetermined at-rest orientation (FIG. 1) and an operation-specific feed orientation (e.g. FIGS. 2 and 4), such movement also typically being effected by stepper motor 34 via the aforementioned arrangement of gears. When the input tray is in an at-rest orientation, the input stack's selected sheet is spaced from the input port, and when the input tray is in a feed orientation, the selected sheet is positioned for passage into the input port. As the thickness of the stack varies, so does the feed orientation of the input tray.

A media level indicator of the printer includes an odometer mechanism 60 which surveys the feed mechanism to quantify the distance traveled by a selected sheet 102 during a given feed operation. This may be accomplished in a variety of ways, but most typically involves use of a counter 62 which counts steps of the stepper motor between commencement and completion of the feed operation. Because the stepper motor effects movement of the input tray in graduated steps, counting steps of the stepper motor quantifies the distance traveled by the input tray. The distance traveled by the selected sheet during a given feed operation thus will be understood to include travel within the input tray and travel about the circumference of the roller. Since the distance traveled after the roller engages the sheet is constant, the distance traveled by the input tray is indicative of the distance traveled by the selected sheet. Accordingly, counting steps of the stepper motor quantifies the distance traveled by the selected sheet.

The odometer mechanism also may employ a timer (inherent in microprocessor 50) which is operatively connected to the sensors to measure the duration of time between commencement and completion of the feed operation. Where motor operation is consistent, the duration of a feed operation is directly related to the distance traveled by the selected sheet during a feed operation, and is inversely related to the amount of media within the input tray.

Commencement and completion of a feed operation may be signaled using hardware, software or firmware, or any combination thereof. In the depicted embodiment, one or more sensors signal commencement and completion of the feed operation, such sensors taking the form of optical sensors such as that shown at 64. Sensor 64, it will be noted, may be used to identify completion of a feed operation by sensing a leading edge of a sheet of a predetermined point along the sheet path. Commencement and/or completion of a feed operation similarly may be identified by microprocessor 50 which typically directs the motor to effect sheet feed. In such a configuration, feed operation could be signaled purely by commands.

In order to minimize error, microprocessor 50 may include a comparator whereby an array is operatively connected to the odometer mechanism to receive and store data values representing the quantified movements of successive feed operations. The data values thus may be compared to an average of N previous data values to identify errors. A predetermined variance between the current data value and an average data value is indicative of an inaccurate current data value.

A status indicator may be operatively connected to the odometer mechanism to signal a low media level when the quantified movement reaches a predetermined value. Such predetermined value represents a quantified distance indicative of a near empty input tray. The status indicator may take the form of a light, a speaker, or any other indicator capable of alerting an operator to a low media condition.

Referring now to FIGS. 1 through 3, a typical feed operation is demonstrated, such operation beginning with the feed mechanism in a stationary configuration and with the input stack spaced from feed roller 32. The feed roller is operated on by motor 34 via gear 42, such gear being positioned between roller gear 33 and motor gear 35. Gear 42 also is configured to drive swing gear 44, which is used to configure additional gears to raise and lower the input stack. It is to be understood, for example, that by reverse operation of the motor (counterclockwise movement of motor gear 35), the swing gear pivots gears 43, 45 into engagement with gear 46 so as to effect subsequent engagement between gears 46, 48 (gear 48 otherwise rotates freely within a recess in gear 46). Gear 46, in turn, effects operation of a linkage arm 70.

In FIG. 2, the motor is shown (by arrows) to rotate motor gear 35 in a clockwise direction, resulting in corresponding counterclockwise rotation of gear 42. This in turn effects clockwise rotation of feed roller 32, and clockwise rotation of swing gear 44. Clockwise rotation of swing gear 44 causes counterclockwise rotation of gear 48, and corresponding clockwise rotation of gear 46. As indicated, rotation of gear 46 results in movement of linkage arm 70. Such movement lifts the input tray to the operation-specific feed orientation shown. It will be understood, however, that the depicted feed orientation is but one of a variety of possible operation-specific feed operations determined by the amount of media in the input tray.

FIG. 3 shows the feed roller and gear arrangement after continued operation of the motor so as to bring a selected sheet within view of sensor 64. At this point, the sensor signals that the feed operation is completed, and the odometer mechanism completes quantification of the distance traveled by the selected sheet.

By comparing the distance traveled by the input tray to reach the first operation-specific feed orientation (when the tray is full as in FIG. 2) with the distance traveled by the input tray to reach a second operation-specific feed orientation (when the tray is less full as in FIG. 4), it will be noted that the distance traveled is indicative of the amount of media in the input tray. For example, sheet 102' of stack 100' (FIG. 4) will travel a greater distance during a feed operation than would sheet 102 of stack 100 (FIG. 2). Therefore, by quantifying such distance as described above, it is possible to identify the amount of media within the input tray.

Figure 5:
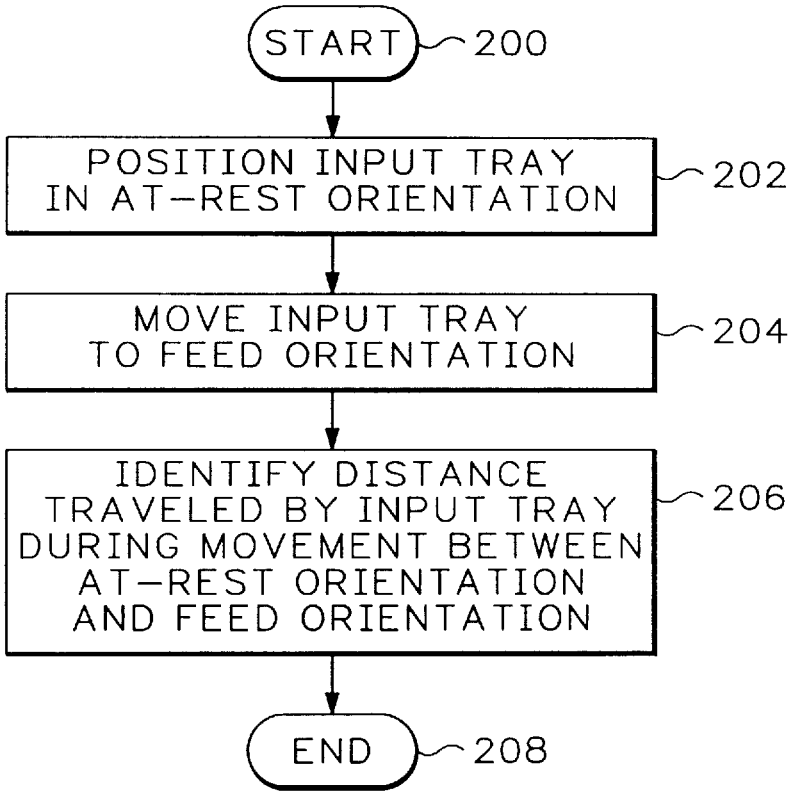
FIG. 5 is a flowchart illustrating a method for use in a sheet processing device to indicate a level of media within an input tray.

Accordingly, printer 10 employs a media level indicator method which tracks the level of media within the printer's input tray. Such method is shown generally in FIG. 5, beginning with a START command 200. The media level indicator method includes the steps of: (1) positioning the input tray in a predetermined at-rest orientation where a selected sheet of the stacked media is spaced from the printer's input port 202; (2) moving the input tray to an operation-specific feed orientation where the selected sheet is positioned for passage into the input port 204; and (3) identifying a distance traveled by the input tray during movement between the at-rest orientation and the feed orientation, such distance being indicative of the level of media within the input tray 206. This is accomplished using one or more sensors configured to signal commencement and completion of each feed operation, and an odometer mechanism which quantifies the distance traveled by a selected sheet (or by the input tray). The method typically ends at 208, but may be repeated with each new feed operation.

As described above, the odometer mechanism quantifies the distance traveled by the selected sheet by counting steps of the stepper motor between commencement and completion of a feed operation. Alternatively, the distance may be quantified using a timer which measures a duration of time between commencement and completion of each feed operation, the distance traveled by the input tray for a given feed operation being identified by the duration of time measured for such feed operation.

The media level indicator method further also may include a step wherein each identified distance is compared to one or more previously identified distances, a predetermined variation being indicative of an erroneous identified distance.

While the present invention has been shown and described with reference to the foregoing operational principles and preferred embodiment, it will be apparent to those skilled in the art that other changes in form and detail may be made therein without departing from the spirit and scope of the invention as defined in the appended claims.

I claim:

1. An apparatus that determines an amount of media in an input stack, comprising:

a sheet processing device which receives media sheets through an input port, the sheet processing device including a feed mechanism configured to selectively move the input stack between a predetermined first position wherein a selected sheet of the input stack is spaced from the input port and an operation-specific second position wherein the selected sheet is positioned for passage into the input port; and an odometer mechanism configured to survey the feed mechanism to quantify movement of the selected sheet during a feed operation, such quantified movement being indicative of an amount of media in the input stack.

2. The apparatus of claim 1, wherein the odometer mechanism includes one or more sensors configured to survey the feed mechanism and signal commencement and completion of a predetermined feed operation, a duration of time between commencement and completion of the predetermined feed operation quantifying movement of the selected sheet.

3. The apparatus of claim 2, wherein the odometer mechanism further includes a timer configured to measure the duration of time between commencement and completion of the predetermined feed operation.

4. The apparatus of claim 1, wherein the feed mechanism includes a motor configured to effect movement of the input stack between the first position and the second position in graduated steps.

5. The apparatus of claim 4, wherein the odometer mechanism includes a counter which quantifies movement of the selected sheet by counting steps of the motor during movement of the input stack between the first position and the second position.

6. The apparatus of claim 1, wherein the feed mechanism includes a motor configured to effect movement of the input stack between the first position and the second position, and to effect passage of the selected sheet from the input stack into the input port in graduated steps.

7. The apparatus of claim 6, wherein the odometer mechanism includes a counter which quantifies movement of the selected sheet by counting steps of the motor during movement of the input stack between the first position and the second position and during passage of the selected sheet from the input stack into the input port.

8. The apparatus of claim 1, further comprising a comparator including an array operatively connected to the odometer mechanism to receive and store data values representing quantified movements of successive feed operations, each data value being compared to an average of N previous data values, a predetermined variance between a current data value and an average data value being indicative of an inaccurate current data value.

9. A media level indicator for use in a sheet processing device having an input port through which media is received, the media level indicator comprising:

an input tray configured to hold a stack of sheet media;

a feed mechanism including a feed roller configured to pass a selected sheet of the stack to the input port; and an odometer mechanism configured to survey the feed mechanism to quantify a distance traveled by the selected sheet during a feed operation wherein the input tray is moved between a predetermined at-rest orientation where the selected sheet is spaced from the feed roller and an operation-specific feed orientation where the selected sheet engages the feed roller for delivery into the input port, such distance being indicative of an amount of media in the input stack.

10. The media level indicator of claim 9, wherein the odometer mechanism includes a timer and one or more sensors configured to survey the feed mechanism and signal commencement and completion of a predetermined feed operation, the timer being operatively connected to the one or more sensors to measure a duration of time between commencement and completion of the predetermined feed operation, the duration of time being directly related to the distance traveled by the selected sheet and inversely related to the amount of media within the input tray.

11. The media level indicator of claim 9, wherein the feed mechanism includes a stepper motor coupled with the input tray to effect movement of the input tray between the at-rest orientation and the feed orientation.

12. The media level indicator of claim 11, wherein the odometer mechanism includes a counter operatively connected to the stepper motor to quantify the distance traveled by the selected sheet by counting steps of the motor during movement of the input tray between the at-rest orientation and the feed orientation.

13. The media level indicator of claim 9, further comprising a comparator including an array operatively connected to the odometer mechanism to receive and store quantified distances corresponding to successive feed operations, each quantified distance being compared to an average of N previous distances, a predetermined variance between a current quantified distance and an average quantified distance being indicative of an inaccurate current quantified distance.

14. A media level indicator method for use a sheet processing device to in indicate a level of media within an input tray which delivers stacked media to an input port, the media level indicator method comprising the steps of:

positioning the input tray in a predetermined at-rest orientation where a selected sheet of the stacked media is spaced from the input port;

moving the input tray to an operation-specific feed orientation where the selected sheet is positioned for passage into the input port; and identifying a distance traveled by the input tray during movement between the at-rest orientation and the feed orientation, such distance being indicative of the level of media within the input tray.

15. The media level indicator method of claim 14, wherein the sheet processing device includes one or more sensors configured to signal commencement and completion of each feed operation.

16. The media level indicator method of claim 15, wherein the sheet processing device includes a timer which measures a duration of time between commencement and completion of each feed operation, the distance traveled by the input tray for a given feed operation being identified by the duration of time measured for such feed operation.

17. The media level indicator method of claim 15, wherein the sheet processing device includes a stepper motor configured to move the input tray between the predetermined at-rest orientation and selected operation-specific feed orientations, the distance traveled by the input tray for a given feed operation being identified by counting steps of the stepper motor between commencement and completion of such feed operation.

18. The media level indicator method of claim 14, further comprising the step of comparing each identified distance to one or more previously identified distances, a predetermined variation being indicative of an erroneous identified distance.

* * * * *

UNITED STATES PATENT AND TRADEMARK OFFICE

CERTIFICATE OF CORRECTION

PATENT NO. : 5,853,171

DATED : December 29, 1998

INVENTOR(S) : Halpenny

It is certified that error appears in the above-identified patent and that said Letters Patent is hereby corrected as shown below:

IN THE CLAIMS:

Column 6, (line 42), after "use" insert --in--.

Column 6, (line 43), after "to" delete "in".

Signed and Sealed this

Thirteenth Day of July, 1999

*Attest:*

*Attesting Officer*

Q. TODD DICKINSON

*Acting Commissioner of Patents and Trademarks*